United States Patent [19]

Tillery

[11] Patent Number: 4,556,219

[45] Date of Patent: Dec. 3, 1985

[54] GOLF PRACTICE CAGE

[76] Inventor: Thomas H. Tillery, 13371 Lee Dr., Westminster, Calif. 92683

[21] Appl. No.: 624,416

[22] Filed: Jun. 25, 1984

[51] Int. Cl.[4] ..... A63B 67/02

[52] U.S. Cl. ..... 273/181 F

[58] Field of Search ..... 273/181 R, 181 C, 181 D, 273/181 F, 181 J, 181 K, 26 A

[56] References Cited

U.S. PATENT DOCUMENTS

| | | | |
|---|---|---|---|
| 920,907 | 5/1909 | Bolton | 273/181 F |
| 1,371,820 | 3/1921 | Sochurek | 273/181 J |
| 1,405,081 | 1/1922 | Whitney | 273/181 F |
| 1,437,591 | 12/1922 | Gray | 273/181 F X |
| 1,503,633 | 8/1924 | Brun | 273/181 J |
| 1,540,670 | 6/1925 | Vidmer | 273/181 F |
| 2,234,814 | 3/1941 | Weaver | 273/181 J |
| 2,329,992 | 9/1943 | King | 273/181 D |
| 2,331,236 | 10/1943 | Schaefer | 273/181 C |
| 2,922,653 | 1/1960 | O'Brien | 273/181 F |
| 3,227,449 | 1/1966 | Schwab | 273/181 F X |
| 3,684,293 | 8/1972 | Brooks | 273/181 K X |
| 3,986,719 | 10/1976 | Lee | 273/181 F |
| 4,068,846 | 1/1978 | Forrest | 273/181 A X |
| 4,116,437 | 9/1978 | Johnson | 273/181 J X |

FOREIGN PATENT DOCUMENTS

| | | | |
|---|---|---|---|
| 407045 | 3/1934 | United Kingdom | 273/181 F |

*Primary Examiner*—William H. Grieb

*Attorney, Agent, or Firm*—Fulwider, Patton, Rieber, Lee & Utecht

[57] ABSTRACT

A golf practice cage having a plurality of nets defining a boxlike enclosure open at the front. The nets are attached to a rigid frame by a plurality of attachment members which locate the net in spaced relation to the frame so that rebounding of flying golf balls is prevented. A pair of free hanging rebound nets at the back of the enclosure absorb impact forces and also prevent golf ball rebound. The net defining the floor is trained at its forward extremity about a lateral frame element which is longitudinally movable to adjust the tension of the floor net. Tension elements are arranged to underlie the floor net to keep it from sagging, and a section of damping material such as carpeting overlies the floor net to prevent golf ball rebound and to define a sloping, generally planar surface to cause golf balls to roll to a collection section at the front of the golf practice cage.

5 Claims, 8 Drawing Figures

GOLF PRACTICE CAGE

BACKGROUND OF THE INVENTION

1. Field of the Invention

The present invention relates to golf practice cages and more particularly to a golf practice cage which includes means to substantially prevent dangerous rebounds of flying golf balls.

2. Description of the Prior Art

Indoor golf driving ranges or practice cages are well known. Many simply comprise a number of nets arranged to form an enclosure which includes a back against which the golf balls are struck. The nets are typically directly attached to rigid elements which define the supporting frame. This arrangement is dangerous because a rapidly traveling golf ball can rebound from one of the supporting frame elements and possibly strike the golfer.

In addition to the rebound problems posed by prior art golf practice cages made of nets, such cages do not provide an easy and reliable means for returning golf balls to the platform area from which the balls are struck. If the floor is defined by a net, the net will generally sag and collect the balls, rather than allowing them to roll toward the golfer's platform. In some instances, prior art golf cages include a rigid supporting floor underlying the floor net to define a surface over which the golf balls can roll, but this introduces rebound problems endangering the golfer. Simply tensioning the floor net does not solve the problem either, inasmuch as it has been found that rapidly traveling golf balls rebound with surprising force from a tensioned net. This is also true of even modestly tensioned nets defining the rear or target wall of the cage.

SUMMARY OF THE INVENTION

According to the present invention, a golf practice cage is provided which comprises a platform upon which a golfer can stand while hitting golf balls, and which includes a ball collection section for receiving golf balls at a ball collection level. The cage includes a frame having a plurality of rigid, interconnected frame elements which support a plurality of nets to define an enclosure having a top, a pair of sides, a rear, and a front which opens onto the golfer's platform. The net constituting the floor slopes downwardly from a target level adjacent the base of the rear wall to the ball collection level so that balls can easily roll to the ball collection section.

Rebound of rapidly traveling golf balls is prevented by employment of attachment members which connect the nets to the frame elements in spaced relation so that a ball cannot strike the supporting frame elements.

A desired generally sloping, planar surface for the cage floor is provided by training a free extremity of the floor net about a transverse member which is longitudinally movable for adjusting net tension. In addition, a plurality of longitudinally extending tension members underlie the floor net to constrain the net against sagging. Finally, a section of damping material such as carpeting is laid on top of the floor net to further aid in defining the desired planar sloping surface, and this material has the unexpected property of substantially preventing dangerous rebounding of golf balls striking the floor. Thus, the combination of carpeting and underlying netting solves both the problem of providing a planar sloping surface, and damping the impact of flying balls.

Other objects and features of the invention will become apparent from consideration of the following description taken in connection with the accompanying drawings.

DESCRIPTION OF THE PREFERRED EMBODIMENT

Figure 1:
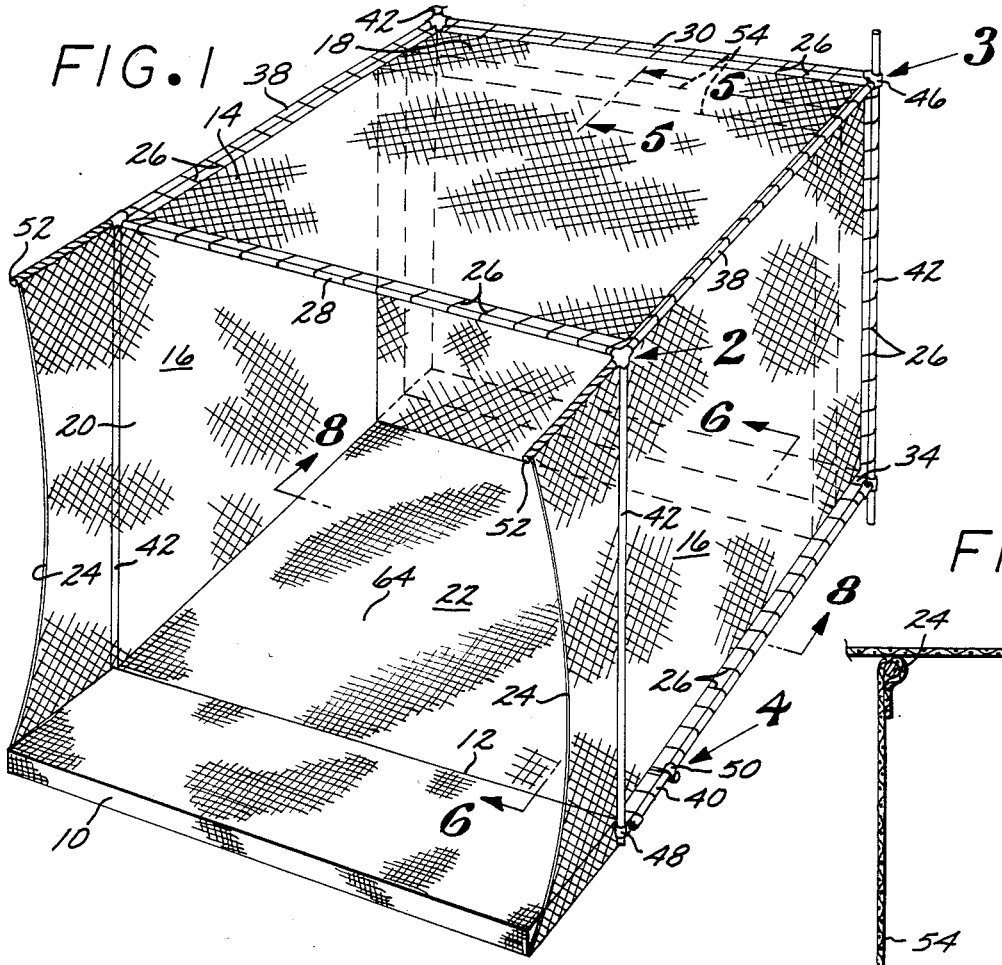
FIG. 1 is a perspective view of a golf practice cage according to the present invention.

Referring now to the drawings, FIG. 1 illustrates the general configuration of the present golf practice cage. The cage is made sufficiently high and wide to allow a golfer to swing without danger of striking any part of the cage structure. The cage can be relatively quickly erected in an indoor space, and several can be installed side by side for use in commercial establishments specializing in the provision of practice facilities for golfers. Although not shown, the cage can be provided with means for automatically teeing up golf balls for striking, and for visually indicating on a suitable readout or display system the probable trajectory and distance the ball would have traveled during normal play.

The cage is completely self-contained and made of relatively inexpensive materials such as structural tubing, common netting, and carpeting material and the like, as will be seen. Although simple in form and relatively inexpensive to fabricate, it makes it possible for a golfer to practice without fear of being struck by rebounding golf balls.

The golf practice cage comprises, generally, a raised platform 10 upon which a golfer can stand while hitting golf balls, and including a ball collection section generally located at 12 for receiving golf balls rolling down the inclined slope of the cage floor from a higher target level adjacent the bottom of the cage rear wall to a lower, ball collection level adjacent the ball collection section 12.

Figure 5:
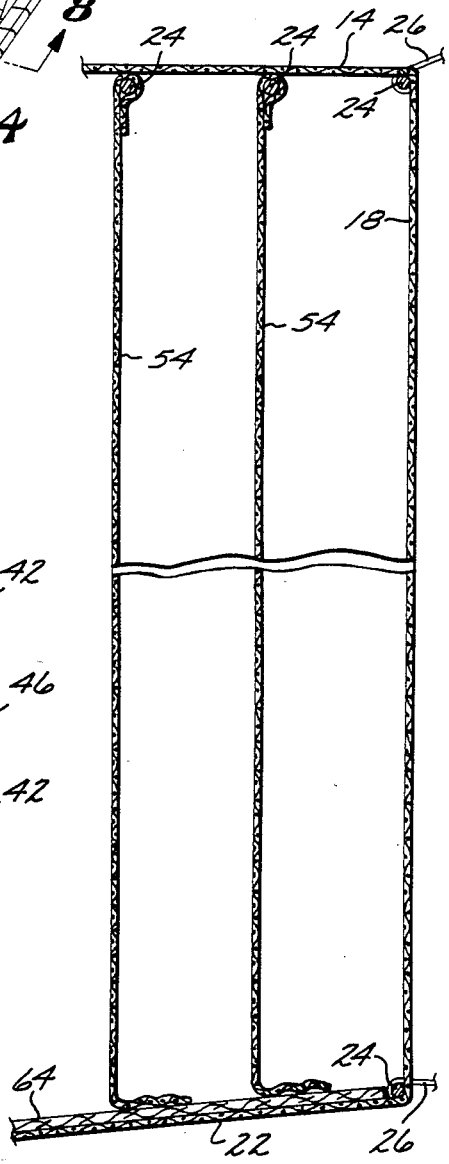
FIG. 5 is an enlarged view taken along the line 5—5 of FIG. 1.

The cage includes a plurality of nets defining an enclosure having a top 14, a pair of sides 16, a rear 18, an open front 20 and a floor 22, as best seen in FIGS. 1 and 5.

The nets embody elongated cords or cables 24, at the corners or juncture lines where the margins of adjacent nets meet, each juncture line including one such cable 24 to which such margins are sewn or otherwise fastened. Except for the cable 24 located in the free front margins of the side nets, each of the cables 24 is secured to a rigid frame by a plurality of attachment members 26, and the cables 24 serve to substantially uniformly distribute the tension forces developed by the attachment members 26. Each attachment member 26 comprises an elongated element having a pair of hooks at its opposite extremities for disposition about the associated one of the cables 24 and about the associated element of the cage frame.

Figure 6:
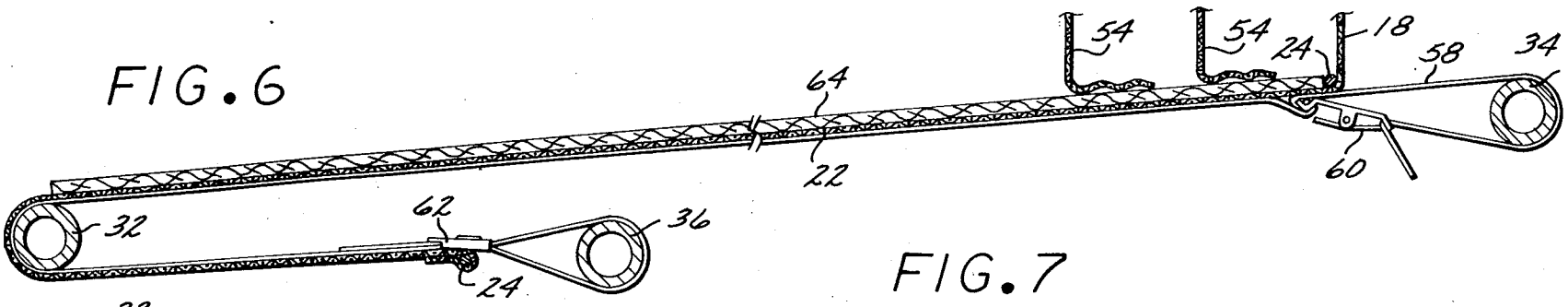
FIG. 6 is an enlarged view taken along the line 6—6 of FIG. 1.

As seen in FIGS. 1 and 6, the cage frame is made up of a plurality of rigid, interconnected and elongated transverse upper front and rear frame elements 28 and 30, transverse lower front and rear frame elements 32 and 34, a lower intermediate frame element 36 between the elements 32 and 34, longitudinal upper frame elements 38, longitudinal lower frame elements, one of which is illustrated at 40 in FIG. 1, and vertical frame elements 42 at the four corners of the cage.

Although any suitable means may be utilized for interconnecting the frame elements, it is preferred to utilize means which enable adjustment of the height, width and depth of the cage.

Figure 2:
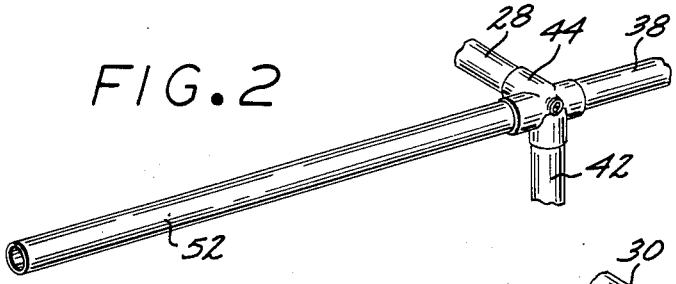
FIG. 2 is an enlarged perspective view of a portion of the cage, taken along the line 2 of FIG. 1.
Figure 3:
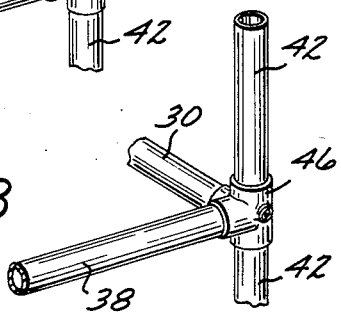
FIG. 3 is an enlarged perspective view of a portion of the cage, taken along the line 3 of FIG. 1.

As seen in FIG. 2, a typical upper front corner connection or fitting 44 embodies one or more Allen screws so that the fitting 44 can be moved along and fixed to the longitudinal frame element 38 once the longitudinal position of the transverse front frame element 28 is adjusted to establish the depth of the cage. The upper rear corner fittings 46 are vertically adjustable, as seen in FIG. 3, embodying an Allen screw to fix the fitting 46 to the vertical frame element 42 once the desired vertical position of the transverse and longitudinal frame elements 30 and 38 are reached to establish the height of the cage.

Figure 4:
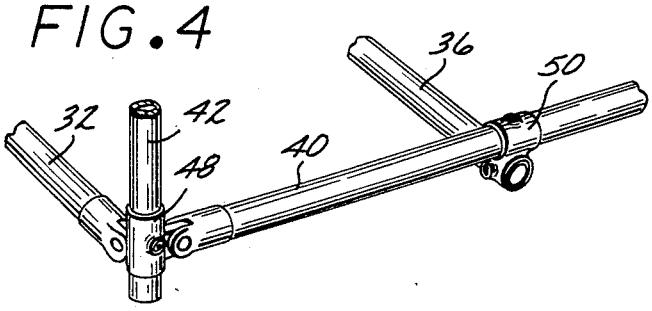
FIG. 4 is an enlarged perspective view of a portion of the cage, taken along the line 4 of FIG. 1.

As seen in FIG. 4, fittings 48 are located at each of the lower four corners of the cage to adjust the vertical height of the transverse frame elements 32 and 34, and the vertical height of the longitudinal frame elements 40, relative to the vertical frame elements 42. This also aids in establishing the height of the cage, and also slopes the floor 22. The floor 22 should slope downwardly from rear to front, and also slope from left to right, as viewed in FIG. 2, to cause the golf balls to roll forward and to the right, and thus into the ball collection section 12. The fittings 48 and the adjacent ends of the frame elements are pivotally connected together to allow the pivotal movement necessary to establish the desired slope.

Also seen in FIG. 4 is one of a pair of fittings 50 which are slidably adjustable along the lengths of the longitudinal frame elements 40 to adjust the longitudinal position of the intermediate frame element 36 for tensioning the net of floor 22, as will be seen.

The attachment members 26 securely attach the respective nets to the frame elements in spaced relation so there is no danger of a flying golf ball striking and rebounding from one of the frame elements. Instead, the balls strike only the netting which, except for the floor and back, is relatively loosely tensioned so that the nets damp the impact of the golf balls. If a ball hits one of the attachment members, the attachment member tends to slide upon the frame element to which it is attached, thereby damping and absorbing the ball impact forces.

The nets defining the sides 16 are extended forwardly toward the platform 10, beyond the forward vertical frame elements 42. The net extensions are suspended from extensions 52 of the upper longitudinal frame elements 38. The net extensions damp errant shots of the golfer, preventing them from striking the forward vertical frame elements 42.

The struck golf balls do not hit the rear 18 of the cage. Instead, a pair of longitudinally spaced apart rebound nets 54 are located ahead of and in spaced relation to the cage rear 18. The rebound nets 54 are also spaced from one another and in generally parallel relation to the rear 18. Their bottom and side edge margins are movable relative to the top 14, sides 16 and floor 22 of the cage, but the cables 24 in their upper edge margins are attached to the top 14. The nets 54 are therefore free to move with the impacting golf balls and thereby prevent dangerous rebounds.

The rebound net cables 24 are conveniently attached at their opposite ends to the upper longitudinal frame elements 38 by any suitable means. Preferably the cables 24 are not attached to the net forming the top 14 since such attachment would tend to increase the degree of rebound of golf balls striking the rebound nets at or near their upper edges.

A ball striking one or both of the rebound nets 54 deflects the netting and generally rolls down the netting to the floor 22 in front of the netting, where it can roll to the ball collection section 12. Any balls that manage to move past the peripheral edges of one or both of the rebound nets 54 roll or fall to the floor net and eventually tend to be swept toward the golfer by the rebound nets 54 as they swing back and forth under the impact of later golf balls hit by the golfer.

Figure 7:
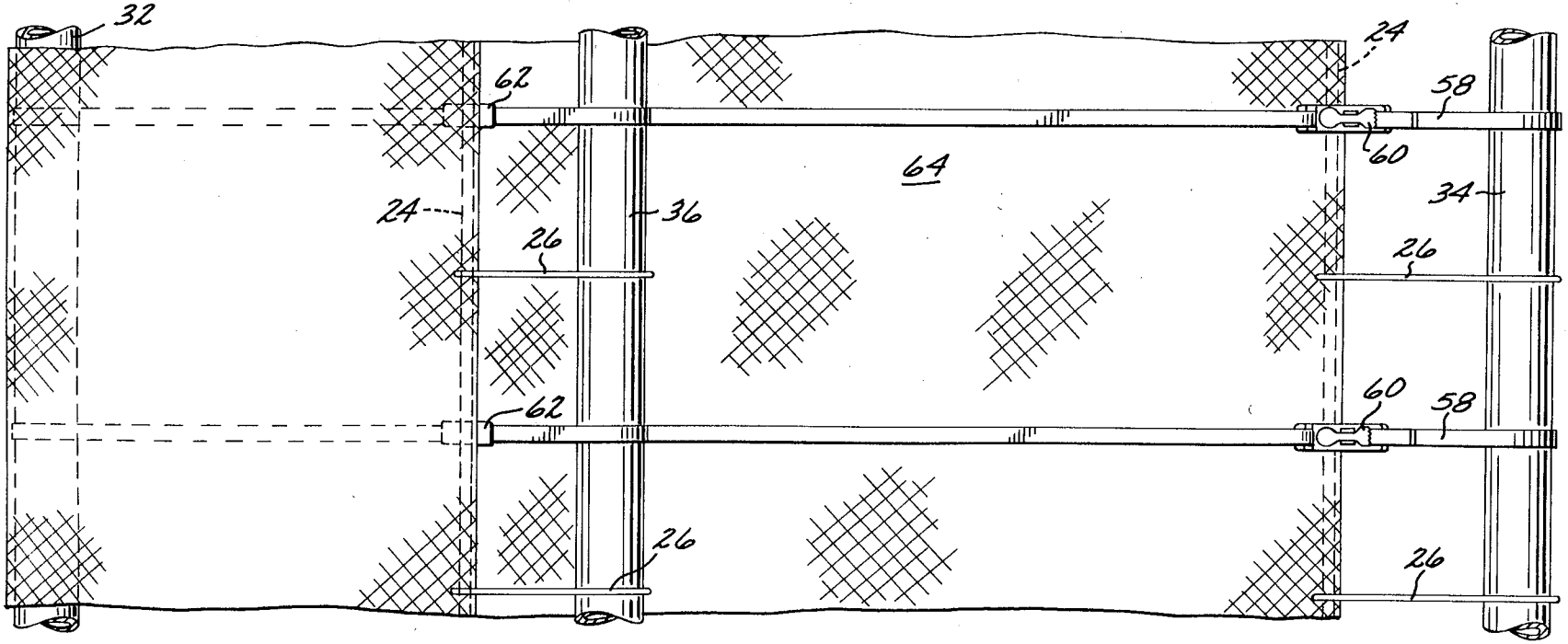
FIG. 7 is a partial bottom plan view of the central portion of the floor shown in FIG. 6.
Figure 8:
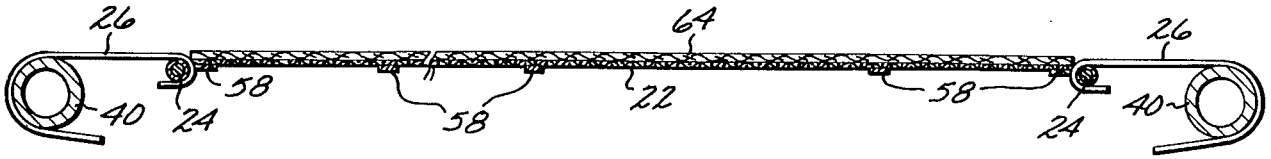
FIG. 8 is an enlarged view taken along the line 8—8 of FIG. 1.

Rebounding of golf balls from the floor of prior art cages has been a major problem, particularly where the floor is highly tensioned or provided with a rigid underlay to provide a sloping planar rolling surface. According to the present invention, the net defining the floor extends from its connection at the rear frame element 34 toward the cage front, as best seen in FIGS. 6 and 7. There it is trained about or reversely directed around the front frame element 32, and then it extends rearwardly toward the intermediate frame element 36. It is attached to element 36 by a plurality of attachment members 26.

As previously indicated, the fittings 50 at the extremities of the intermediate member 36 can be loosened to enable its longitudinal movement to adjust tensioning of the floor net. The tensioned floor net may still have a tendency to sag. To insure against this a plurality of longitudinally extending, laterally spaced apart tensioning means or elements 58 are arranged to underlie the net.

The tension elements 58, which are preferably made of rubber or other elastomeric material, are each looped at one extremity about the rear frame element 34. There they are secured by any suitable attachment means, such as a clamp 60. One suitable clamp available in the prior art receives the associated tension element 58 at one end and clamps at its other end clamps against the free extremity of the tension element 58 to constrain it against movement out of the clamp.

Like the floor net, the tension elements 58 extend forwardly, around the front frame element 32, and back to the intermediate frame element 36 where they are attached by suitable clamps 62. The clamps 62 need not be adjustable, instead being operative to semipermanently hold the free end of the tension element 58 from moving relative to the standing part of the element 58.

The tension elements are forcibly stretched until the floor net does not sag, the clamps 60 then being operated to maintain the elements 58 in their tensioned condition.

In the absence of any further damping medium it was found that the tensioned floor net would not satisfactorily prevent impacting golf balls from rebounding at unacceptably high velocities. Surprisingly, it was found that placement on the floor net of a material much denser and less deflectable than netting had the effect of stopping all dangerous rebounds. This damping material preferably takes the form of a rectangular section of carpeting 64 placed on top of the floor net, preferably unattached. One form of carpeting 64 that performs particularly well is known in the trade as "indoor-outdoor" carpeting. It is theorized that the netting may be deflecting appreciably to take up high impact forces, but that the carpeting delays the rapid recovery of the netting from such deflection. As a consequence, high velocity rebounds are prevented, and the carpeting is rigid enough that it tends to maintain the planar surface needed to cause golf balls to roll to the ball collection area.

The spacing of the cage nets away from the supporting framework, the employment of free swinging rebound nets, the use of tensioning and anti-sag support means for the floor net, and the combination of the tensioned floor net with a denser, more rigid damping material overlying the floor net, all contribute to the prevention of rebounds of flying golf balls, enabling a golfer to practice without fear of injury.

Various modifications and changes may be made with regard to the foregoing detailed description without departing from the spirit of the invention.

I claim:

1. A golf practice cage comprising:

a platform upon which a golfer can stand while hitting golf balls, and including a ball collection section for receiving golf balls at a ball collection level;

a frame including a plurality of rigid, interconnected elongated frame elements;

a plurality of nets defining an enclosure having a top, a pair of sides, a rear and a front opening onto said platform, one of said nets constituting a floor net sloping downwardly from a target level adjacent the base of said rear to said ball collection level;

a plurality of attachment members extending between and connected to said nets and said frame elements to support and tauten said nets on said frame in spaced relation to said frame elements to prevent impact of flying balls against said frame elements;

a layer of damping material overlying said floor net for preventing dangerous rebounding of flying golf balls;

a plurality of laterally spaced apart tension elements underlying said floor net and extending between said front and rear frame elements; and a plurality of tightening means connected between said plurality of tension elements, respectively, and one of said front and rear frame elements, and operable to tauten said tension elements and urge said floor net into a generally planar surface sloping from said target level to said ball collection level.

2. A golf practice cage according to claim 1 wherein said damping material comprises carpeting.

3. A golf practice cage comprising:

a platform upon which a golfer can stand while hitting golf balls, and including a ball collection section for receiving golf balls at a ball collection level;

a plurality of nets defining an enclosure having a top, a pair of sides, a rear and a front opening onto said platform, one of said nets constituting a floor sloping downwardly from a target level adjacent the base of said rear to said ball collection level;

a frame including a plurality of rigid, interconnected elongated frame elements;

certain of said frame elements comprising a transverse front frame element located adjacent the front extremity of said floor, a transverse rear frame element located adjacent the rear extremity of said floor, and a transverse intermediate frame element located between said front and rear frame elements, said intermediate frame element being longitudinally adjustably coupled at its extremities to others of said frame elements extending longitudinally adjacent said floor, and wherein said net defining said floor extends forwardly from said rear frame element, is trained about said front frame element, and then extends rearwardly toward said intermediate frame element;

a first plurality of attachment members extending between and connected to said nets and said frame elements to support said nets on said frame in spaced relation to said frame elements to prevent impact of flying golf balls against said frame elements; and a second plurality of attachment members connecting said net defining said floor to said intermediate frame element whereby longitudinal adjustable movement of said intermediate frame element varies the tension exerted upon said net defining said floor.

4. A golf practice cage comprising:

a platform upon which a golfer can stand while hitting golf balls, and including a ball collection section for receiving golf balls at a ball collection level;

a frame;

a plurality of nets supported by said frame and defining an enclosure having a top, a pair of sides, a rear, and a front opening onto said platform, one of said nets constituting a floor net sloping downwardly from a target level adjacent the base of said rear wall to said ball collection level;

damping material overlying said floor for preventing dangerous rebounds of flying golf balls, said damping material defining a generally planar surface for golf balls to roll from said target level to said ball collection level;

a plurality of laterally spaced apart tension elements underlying said floor net and extending between said front and said rear; and a plurality of tightening means connected between said frame and said plurality of tension elements, respectively, and operable to tauten said tension elements and urge said floor net into a generally planar surface sloping from said target level to said ball collection level.

5. A golf practice cage according to claim 4 wherein said damping material comprises carpeting.

* * * * *